US007204327B2

(12) United States Patent
Livingstone

(10) Patent No.: US 7,204,327 B2
(45) **Date of Patent: *Apr. 17, 2007**

(54) REVERSE CIRCULATION DIRECTIONAL AND HORIZONTAL DRILLING USING CONCENTRIC DRILL STRING

(75) Inventor: James I. Livingstone, Calgary (CA)

(73) Assignee: Presssol Ltd., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/644,748

(22) Filed: Aug. 21, 2003

(65) Prior Publication Data

US 2004/0079553 A1 Apr. 29, 2004

Related U.S. Application Data

(60) Provisional application No. 60/404,787, filed on Aug. 21, 2002.

(51) Int. Cl.
*E21B 17/18* (2006.01)

(52) U.S. Cl. ..... 175/318; 175/324

(58) Field of Classification Search ..... 175/213, 175/215, 61, 324, 62, 318
See application file for complete search history.

(56) References Cited

U.S. PATENT DOCUMENTS 1,850,403 A * 3/1932 Lee ..... 175/74
2,609,836 A 9/1952 Knox
3,075,589 A 1/1963 Grable et al.
3,416,618 A 12/1968 Kunnemann
3,770,006 A 11/1973 Sexton et al.
3,792,429 A 2/1974 Patton et al.
3,795,283 A 3/1974 Oughton
3,920,090 A 11/1975 McQueen et al.
4,043,136 A * 8/1977 Cherrington ..... 405/161
4,055,224 A 10/1977 Wallers
4,100,528 A 7/1978 Bernard et al.
4,219,087 A 8/1980 Johnson
4,243,252 A 1/1981 Johnson (Continued)

FOREIGN PATENT DOCUMENTS

CA 1325969 10/1987

(Continued)

OTHER PUBLICATIONS

U.S. Appl. No. 10/644,749, filed on Aug. 21, 2003 by Livingstone.*

(Continued)

*Primary Examiner*—Jennifer H. Gay
*Assistant Examiner*—Daniel P Stephenson
(74) *Attorney, Agent, or Firm*—Bennett Jones LLP

(57) ABSTRACT

Method and apparatus for drilling a directional or horizontal wellbore in a hydrocarbon formation using concentric drill string having an inner pipe and an outer pipe defining an annulus there between. A bottomhole assembly comprising a directional drilling means such as an air hammer or a rotary drill bit and driving system is provide at the lower end of the concentric drill string and drilling medium is delivered through the annulus or inner pipe for operating the directional drilling means to form a borehole. Exhaust drilling medium, drilling cutting and hydrocarbon are removed from the wellbore by extracting the exhaust drilling medium, drilling cutting and hydrocarbon through the other of the annulus or inner pipe.

50 Claims, 12 Drawing Sheets

U.S. PATENT DOCUMENTS 4,244,431 A * 1/1981 Johnson ..... 175/320
4,321,974 A 3/1982 Klemm
4,391,328 A 7/1983 Aumann
4,431,069 A 2/1984 Dickinson, III et al.
4,461,448 A 7/1984 Huey et al.
4,463,814 A 8/1984 Horstmeyer et al.
4,509,606 A 4/1985 Willis
4,534,426 A 8/1985 Hooper
4,543,019 A * 9/1985 Shikata ..... 408/57
4,647,002 A 3/1987 Crutchfield
4,671,359 A 6/1987 Renfro
4,681,164 A 7/1987 Stacks
4,705,119 A 11/1987 Kostylev et al.
4,709,768 A 12/1987 Kostylev et al.
4,718,503 A 1/1988 Stewart
4,739,844 A 4/1988 Farris et al.
4,744,420 A 5/1988 Patterson et al.
4,790,391 A 12/1988 Hamamura et al.
4,832,126 A 5/1989 Roche
5,006,046 A 4/1991 Buckman et al.
5,020,611 A 6/1991 Morgan et al.
5,033,545 A 7/1991 Sudol
5,068,842 A 11/1991 Naito
5,148,875 A * 9/1992 Karlsson et al. ..... 175/62
5,174,394 A 12/1992 Fischer et al.
5,178,223 A * 1/1993 Smet ..... 175/424
5,186,266 A * 2/1993 Heller ..... 175/215
5,199,515 A 4/1993 Sinclair et al.
5,236,036 A 8/1993 Ungemach et al.
5,285,204 A 2/1994 Sas-Jaworsky
5,348,097 A 9/1994 Giannesini et al.
5,396,966 A 3/1995 Roos, Jr. et al.
5,411,105 A 5/1995 Gray
5,435,395 A 7/1995 Connell
5,513,528 A 5/1996 Holenka et al.
5,575,451 A 11/1996 Colvin et al.
5,638,904 A 6/1997 Misselbrook et al.
5,720,356 A 2/1998 Gardes
5,881,813 A 3/1999 Brannon et al.
5,890,540 A 4/1999 Pia et al.
5,892,460 A 4/1999 Jerabek et al.
6,015,015 A 1/2000 Luft et al.
6,047,784 A * 4/2000 Dorel ..... 175/61
6,065,550 A 5/2000 Gardes
6,109,370 A * 8/2000 Gray ..... 175/61
6,158,531 A 12/2000 Vail, III
6,189,617 B1 2/2001 Sorhus et al.
6,192,985 B1 2/2001 Hinkel et al.
6,196,336 B1 3/2001 Fincher et al.
6,209,663 B1 4/2001 Hosie
6,209,665 B1 4/2001 Holte
6,213,201 B1 4/2001 Renkis
6,250,383 B1 6/2001 Patel
6,263,987 B1 7/2001 Vail, III
6,325,159 B1 12/2001 Peterman et al.
6,359,438 B1 3/2002 Bittar
6,377,050 B1 4/2002 Chemali et al.
6,394,197 B1 5/2002 Holte
6,405,809 B2 6/2002 Patel et al.
6,481,501 B2 11/2002 Chavez et al.
2002/0000332 A1 1/2002 Merecka et al.
2003/0141111 A1 7/2003 Pia
2003/0150621 A1 8/2003 Pia

FOREIGN PATENT DOCUMENTS

EP 0787886 5/1997
EP 1 245 783 2/2002
FR 2597150 4/1986
GB 2368079 10/2000
WO WO 97/05361 2/1997
WO WO 97/35093 9/1997
WO WO 00/57019 9/2000
WO WO 01/90528 11/2001
WO WO 02/10549 2/2002

OTHER PUBLICATIONS

Underbalanced Drilling; Nowsco.
Nowsco/Downhole Systems: "Test, Treat, Test System Using a Concentric Coiled Tubing/DST Package": Hoyer, Fried & Sask.
BlackMax Downhole Tools; An NQL Drilling Tools Inc. Company; Electro Magnetic Measurement While Drilling; Oil & Gas Application; EM=MWD.
Logging While Drilling; http://www.odp.tamu.edu/publications/196_IR/chap_2/c2_.htm.
Drilling and Formation Evaluation; Baker Hughes; www.bakerhughes.com/bakerhughes/products/well.htm.
On Trak MWD System; Baker Hughes; www. bakerhughes.com/inteq/evaluation/ontrak/index.htm.
PressTEQ Application Examples; Baker Hughes; www.bakerhughes.com/inteq/D&P/pressure/index.htm.
Thruster Drilling System; Baker Hughes; www.bakerhughes.com/inteq/Drilling/thruster/index.htm.
Coiled Tubing; Baker Hughes; Baker Oil Tools Coiled Tubing Solutions; www.bakerhughes.com/bot/coiled_tubing/index/htm.
COLT Coil Tubing Drilling Bottom Hole Assembly; Antech Special Engineering Products; Coiled Tubing Downhole Tools.
U.S. Appl. No. 10/644,749, filed on Aug. 21, 2003 by James Livingstone.

* cited by examiner

680

680

REVERSE CIRCULATION DIRECTIONAL AND HORIZONTAL DRILLING USING CONCENTRIC DRILL STRING

This application claims the benefit of U.S. Provisional Application No. 60/404,787, filed on Aug. 21, 2002.

FIELD OF THE INVENTION

The present invention relates generally to a drilling method and assembly for exploration and production of oil, natural gas, coal bed methane, methane hydrates, and the like. More particularly, the present invention relates to a two string, or dual wall pipe drilling method and apparatus useful for reverse circulation drilling of directional and horizontal wellbores.

BACKGROUND OF THE INVENTION

Conventional directional and horizontal drilling typically uses single wall jointed drill pipe with a drill bit attached at one end. Weighted drilling mud or fluid is pumped through a rotating drill pipe to drive the drill bit to drill a borehole. The drill cuttings and exhausted drilling mud and fluid are returned to the surface up the annulus between the drill pipe and the formation by using mud, fluids, gases or various combinations of each to create enough pressure to transport the cuttings out of the wellbore. Compressed air can also be used to drive a rotary drill bit or air hammer.

However, in order to transport the drill cuttings out of the wellbore, the hydrostatic head of the fluid column can often exceed the pressure of the formation being drilled. Therefore, the drilling mud or fluid can invade into the formation, causing significant damage to the formation, which ultimately results in loss of production. In addition, the drill cuttings themselves can cause damage to the formation as a result of the continued contact with the formation. Air drilling with a rotary drill bit or air hammer can also damage the formation by exceeding the formation pressure and by forcing the drill cuttings into the formation.

Underbalanced directional and horizontal drilling technology has been developed to reduce the risk of formation damage due to the hydrostatic head of the fluid column, which uses a mud or fluid system that is not weighted. Hence, drill cutting can be removed without having the fluid column hydrostatic head exceed the formation being drilled resulting in less damage to the formation. Underbalanced drilling technique s typically use a commingled stream of liquid and gas such as nitrogen or carbon dioxide as the drilling fluid.

Even when using underbalanced directional or horizontal drilling technology, there still is the possibility of damage to the formation. The drilling fluid and drill cuttings are still being returned to the surface via the annulus between the drill pipe and the formation wall. Some damage to the formation may still occur due to the continued contact of the drilling cuttings and fluid with the formation. Often, some of the drill cuttings are left in the deviated and horizontal sections of the wellbore in underbalanced drilled wells. As well, underbalanced drilling is very expensive for wells with low or moderate production rates.

Formation damage is becoming a serious problem for exploration and production of unconventional petroleum resources. Conventional natural gas resources are buoyancy driven deposits with much higher formation pressures. Unconventional natural gas formations such as gas in low permeability or tight reservoirs, coal bed methane, and shale gases are not buoyancy driven accumulations and thus have much lower pressures. Therefore, such formations would damage much easier when using conventional oil and gas directional or horizontal drilling technology.

The present invention reduces the amount of pressure which normally results when using air drilling, mud drilling, fluid drilling and underbalanced drilling by using a two string drilling system, thereby greatly reducing formation damage.

SUMMARY OF THE INVENTION

The present invention allows for the drilling of directional and horizontal wells into hydrocarbon formations with less damage and in a safe and economical manner. The present invention works particularly well in low and under pressure hydrocarbon formations. Existing underbalanced technologies may be too expensive and prolonged exposure of the wellbore walls to fluids and drill cuttings can damage the formation. Further, with existing underbalanced technologies, there is a higher risk that not all of the drill cuttings are returned to the surface.

The present invention has a number of advantages over conventional directional and horizontal drilling, namely;

1. it reduces drilling damage to the formation;
2. it reduces the accumulation of drill cuttings along the directional or horizontal section of a wellbore;
3. drill cuttings and other materials are returned from the formation through the inner pipe or annulus of the concentric drill string, thus these materials are not pushed between the outside of the drill string and the wellbore wall; and
4. it reduces the chance of a drill string becoming stuck due to the availability of three annuluses to circulate through when using a concentric drill string.

The present invention can be used to drill an entire well or can be used in conjunction with conventional drilling technology. For example, the top portion of a hydrocarbon bearing formation can first be drilled using conventional drill pipe and the build section of the horizontal well completed. The casing is cemented in the 90 degree built section. The drill rig then changes to a concentric drill string, a downhole blowout preventor is added to the bottomhole assembly and the concentric drill string is then tripped back into the wellbore.

The present invention is also useful for well stimulation. Hydraulic fracturing has been one of the most common methods of well stimulation in the oil and gas industry. This method of stimulation is not as effective in low and under pressure reservoirs. Five types of reservoir damage can occur in low and under pressure reservoirs when hydraulic fracturing is used, namely 1. the pore throats in the rock plug up due to the movement of secondary clays;
2. fracturing gel, fracturing sand and fracturing acid compounds remain in the reservoir;
3. swelling of smectitic clays;
4. chemical additives cause precipitation of minerals and compounds in the reservoir; and
5. improper clean out of wellbore to remove materials from deviated section of the wellbore can cause serious damage to producing reservoirs.

Accessing natural fractures is one of the most important parts of completing any well in the oil and gas industry, and this is critical to the success of a low or under pressure well. Studies conducted by the United States Department of Energy showed that In a blanket gas reservoir on average a vertical drilled well encounters one fracture, a deviated drilled well encounters fifty-two fractures and a horizontally drilled well thirty-seven fractures.

Use of the reverse circulation drilling method and apparatus for forming directional and horizontal wells provides the necessary stimulation of the well without the damage caused by hydraulic fracturing.

Thus, the present invention allows low and under pressure formations or reservoirs to receive the necessary well stimulation without damage that is usually encountered using hydraulic fracturing.

A method for drilling a directional or horizontal wellbore in a hydrocarbon formation is provided herein, comprising the steps of:

providing a concentric drill string having an inner pipe, said inner pipe having an inside wall and an outside wall and situated within an outer pipe having an inside wall and an outside wall, said outside wall of said inner pipe and said inside wall of said outer pipe defining an annulus between the pipes;

connecting a bottomhole assembly comprising a directional drilling means to the concentric drill string;

delivering drilling medium through one of said annulus or inner pipe for operating the directional drilling means to form said directional or horizontal wellbore and removing exhaust drilling medium by extracting said exhaust drilling medium through said other of said annulus or inner pipe.

In a preferred embodiment, the drilling medium is delivered through the annulus and drill cuttings, exhaust drilling medium and hydrocarbons are removed through the inner tube.

In a further preferred embodiment, the drilling medium is delivered through the inner tube and exhaust drilling medium is removed through the annulus. Any drill cuttings and hydrocarbons will also be removed through the annulus.

The method for drilling a directional or horizontal wellbore can further comprise the step of preventing any flow of hydrocarbons from the inner pipe or the annulus or both to the surface of the wellbore when the need arises by providing a downhole flow control means positioned near the directional drilling means. Typically, the flow control means will operate to shut down the flow from both the inner pipe and the annulus when joints of concentric drill string are being added or removed.

In another preferred embodiment, the method for drilling a directional or horizontal wellbore can further comprise the step of providing a surface flow control means for preventing any flow of hydrocarbons from the space between the outside wall of the outer pipe and the walls of the wellbore. This as well is important when adding or removing joints of concentric drill string.

In one preferred embodiment, the directional drilling means comprises a drill bit or a reciprocating air hammer and a bent sub or housing for positioning the drill bit and air hammer in the proper direction, and the drilling medium is compressed air, The bottomhole assembly can further comprise a downhole data collection and transmission means such as a measurements-while-drilling (MWD) tool for providing formation pressure and temperature and wellbore trajectory, a shock sub for reducing the amount of vibration received by the MWD tool, a drill collar and an interchange means for directing exhaust drilling medium through the annulus or the inner pipe.

In another preferred embodiment, the directional drilling means is a rotary drill bit, which uses a rotary table or top drive drilling system and a bent sub or housing, and the drilling medium is drilling mud, drilling fluid, gases or various combinations of each.

The bottomhole assembly can further comprise one or more of the following downhole tools: a MWD tool, a logging-while-drilling (LWD) tool, a downhole blowout preventor and interchange means for adapting the various tools to dual wall drill pipe. Where drilling conditions require, stabilizers, drill collars and jarring devices can also be added to the bottomhole assembly, as well as other drilling tools to meet various drilling requirements which are known in the art.

The present invention further provides an apparatus for drilling a directional or horizontal wellbore in hydrocarbon formations, comprising:

a concentric drill string having an inner pipe having an inside wall and an outside wall and an outer pipe having an inside wall and an outside wall, said outside wall of said inner pipe and said inside wall of said outer pipe defining an annulus between the pipes;

a bottomhole assembly comprising a directional drilling means operably connected to the lower end of said concentric drill string; and a drilling medium delivery means for delivering drilling medium through one of said annulus or inner pipe for operating the directional drilling means to form said directional or horizontal wellbore and for removing exhaust drilling medium through said other of said annulus or inner tube.

The drilling medium can be air, drilling mud, drilling fluids, gases or various combinations of each.

In a preferred embodiment, the bottomhole assembly further comprises one or more tools selected from the group consisting of a downhole data collection and transmission means, a shock sub, a drill collar, and an interchange means.

In a preferred embodiment, the downhole data collection and transmission means comprises a measurement-while-drilling tool or a logging-while-drilling tool or both.

In a preferred embodiment, the apparatus further comprises a downhole flow control means positioned near the directional drilling means for preventing flow of hydrocarbons from the inner pipe or the annulus or both to the surface of the wellbore.

In a further preferred embodiment, the apparatus further comprises a surface flow control means for preventing any flow of hydrocarbons from the space between the outside wall of the outer pipe and the walls of the wellbore.

DESCRIPTION OF THE PREFERRED EMBODIMENTS

Apparatus and methods of operation of that apparatus are disclosed herein in the preferred embodiments of the invention that allow for drilling a directional or horizontal wellbore in hydrocarbon formations. From these preferred embodiments, a person skilled in the art can understand how this reverse circulation directional and horizontal drilling process can be used safely in the oil and gas industry.

Figure 1:
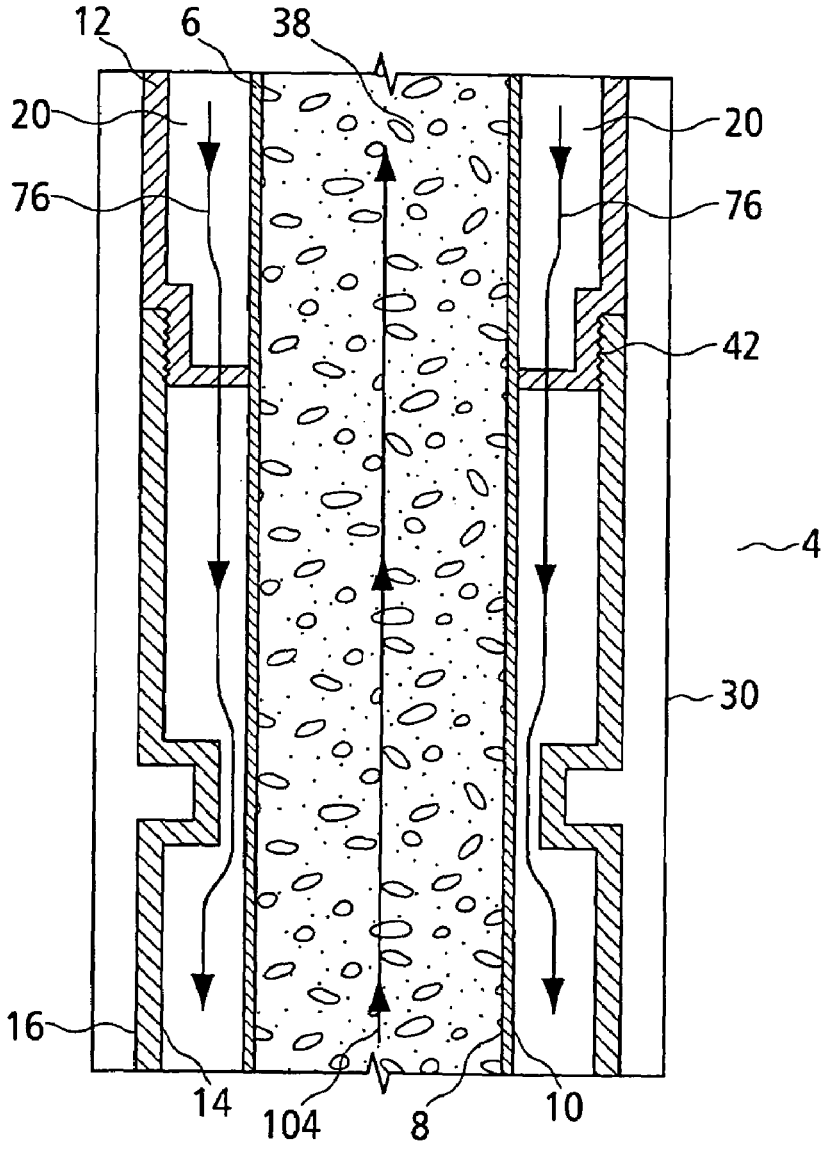
FIG. 1 is a vertical cross-section of a section of concentric drill string.

FIG. 1 is a vertical cross-section of a section of concentric drill string 4. Concentric drill string 4 comprises an inner pipe 6 having an inside wall 8 and an outside wall 10 and an outer pipe 12 having an inside wall 14 and an outside wall 16. The diameter of inner pipe 6 and outer pipe 12 can vary; in one embodiment of the invention, the outer diameter of the outer pipe 12 is 4½ inches and the outer diameter of the inner pipe 6 is 2½ inches. Joints of concentric drill string 4 are attached one to another by means such as threading means 42 to form a continuous drill string. The bottomhole assembly is attached to the concentric drill string 4 by threading means 42. As discussed in more detail below, bottomhole assembly comprises a variety of specialty tools and components which are also attached one to the other by comparable threading means.

Concentric drill string annulus 20 is formed between the outside wall 10 of the inner pipe 6 and the inside wall 14 of the outer pipe 12. Drilling medium 76, for example, drilling mud, drilling fluid, compressed air or commingled mixtures of drilling mud, fluids and gases such as nitrogen and carbon dioxide, is pumped down concentric drill string annulus 20 and removed through the inner pipe. Drill cuttings 38 are removed through the inner pipe along with the exhausted drilling medium 104.

Figure 2A:
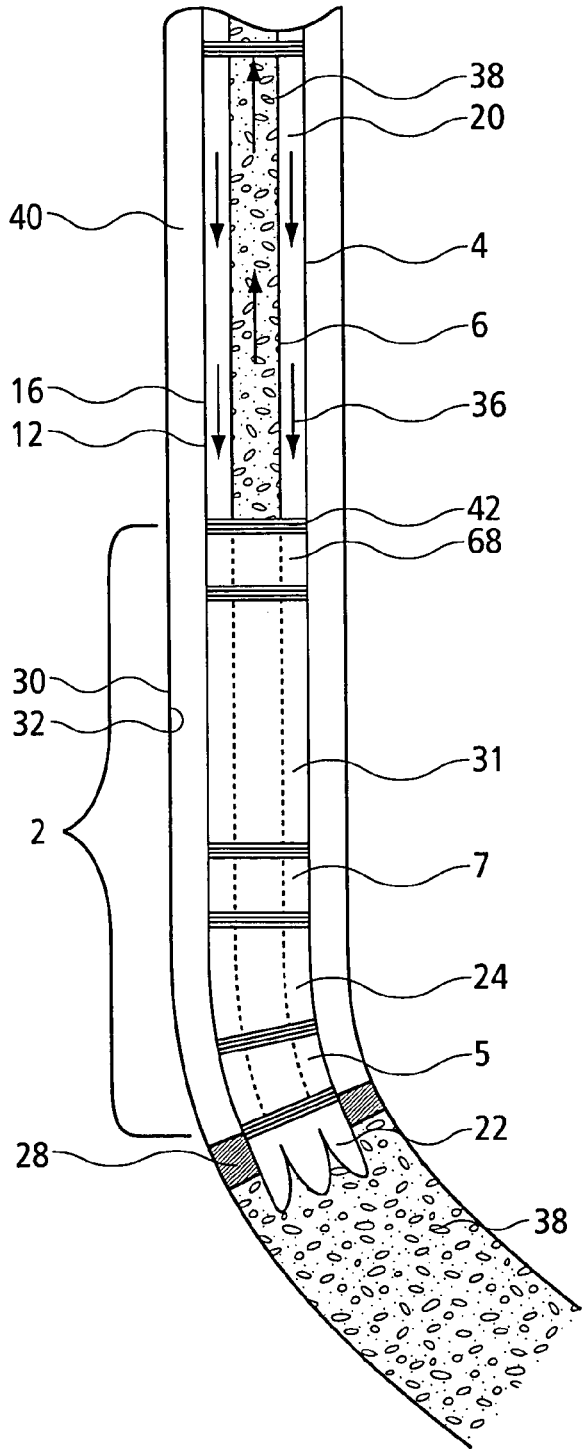
FIG. 2*a* is a schematic illustration of one embodiment of a bottomhole assembly of the present invention for directional and horizontal drilling.

FIG. 2*a* is a schematic illustration of a bottomhole assembly 2 attached to concentric drill string 4 by threading means 42. In this embodiment, all bottomhole tools which comprise the bottomhole assembly 2 have been adapted for use with concentric drill string and reverse circulation drilling. For example, an outer casing can be provided for encasing existing drilling tools for single wall drill string, thereby providing an annulus between the outer wall of the drilling tool and the inner wall of the outer casing.

Bottomhole assembly 2 as shown in this embodiment is operated by compressed air 36 traveling down concentric drill string annulus 20. Bottomhole assembly 2 comprises a directional drilling means having a wearing drill bit 22. Wearing drill bit 22 is connected to bent sub 5, which positions wearing drill bit 22 in the desired direction. Bent sub 5 is connected to air motor 24, which rotates drill bit 22. In another embodiment, a drill bit with a bent sub 5 can be used. It is understood that a bent housing can also be used which houses the air motor for positioning of the wearing drill bit.

As drill bit 22 cuts formation rock, exhausted air and drill cuttings are carried to the surface through inner pipe 6. The compressed air 36 is of sufficient velocity to pick up and carry all drill cuttings 38 to the surface of the wellbore through the inner pipe 6.

A shroud 28 may be located between drill bit 22 and the formation 30 in relatively air tight and frictional engagement with the inner wellbore wall 32. Shroud 28 prevents compressed air 36 and drill cuttings 38 from escaping up the formation annulus 40 between the outside wall 16 of the outer pipe 12 of the concentric drill string 4 and the inner wellbore wall 32.

The bottomhole assembly 2 further comprises a downhole telemetry measurement and transmission device, commonly referred to in the industry as a measurements-while-drilling (MWD) tool 31, which is used in directional and horizontal drilling to evaluate a number of physical properties such as, but not limited to, pressure, temperature, and wellbore trajectory in three-dimensional space. The MWD tool 31 transmits the drilling associated parameters to the surface by mud pulse, electromagnetic transmission or the like. These signals are received by a data receiving device which is commercially available and necessary with the use of MWD tool 31. An optional tool, called logging-while-drilling (LWD) tool (not shown), which measures formation parameters such as resistivity, porosity, sonic, velocity and gamma can also be part of the bottomhole assembly 2. Shock sub 7 is placed between air motor 24 and MWD tool 31 to reduce the amount of vibration MDW tool 31 receives from the drilling operation. Downhole assembly 2 further comprises a downhole blowout preventor or flow control means 68 to prevent hydrocarbons from coming up inner pipe 6 and concentric drill string annulus 20, should the need arise.

Figure 2B:
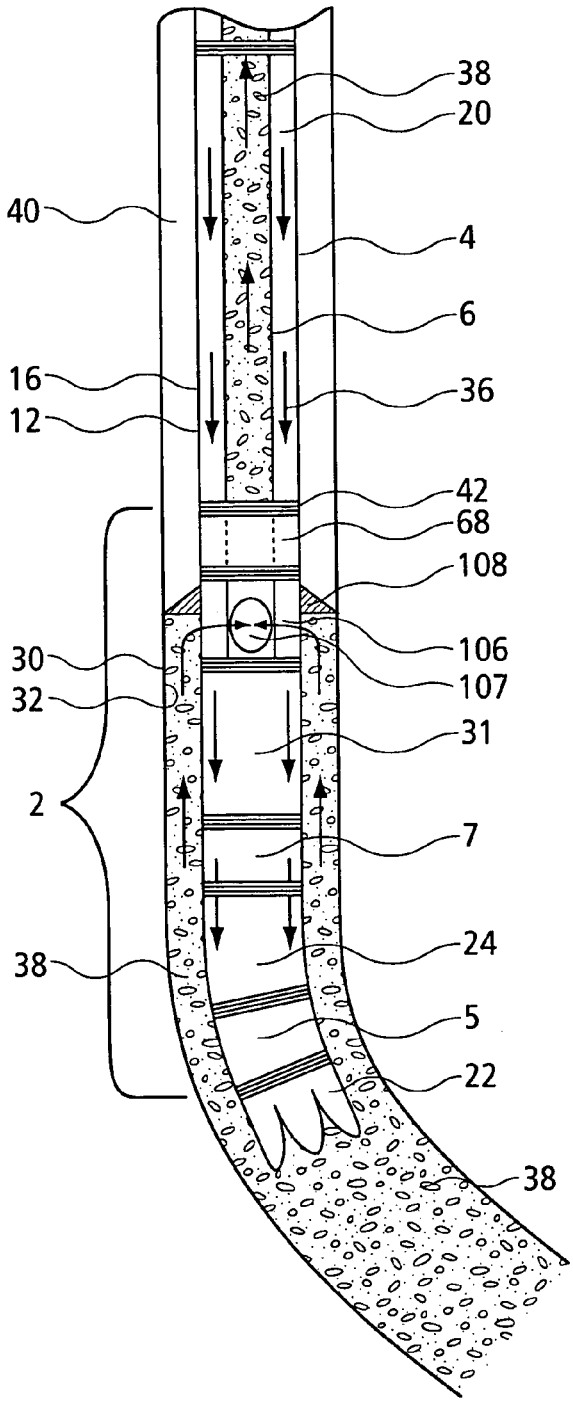
FIG. 2*b* is a schematic illustration of another embodiment of a bottomhole assembly having an interchange means for directional and horizontal drilling.

FIG. 2*b* is a schematic illustration of a preferred embodiment which uses conventional drilling tools used with single walled drill pipe. In this embodiment, bottomhole assembly 22 comprises an interchange means 106 for diverting drill cuttings 38 from the formation annulus 40 into the inner pipe 6. Interchange means 106 comprises vertical slot 107 to let drill cuttings 38 escape through the center of inner pipe 6. Interchange means 106 further comprises wings or shroud 108 which prevents drill cuttings 38 from continuing up the formation annulus to the surface of the wellbore. Generally, if the wellbore being drilled is 6¼ inches in diameter, the outer diameter (OD) of the interchange means 106 would be 5½ inches, which would include the wings or shroud 108.

Figure 3A:
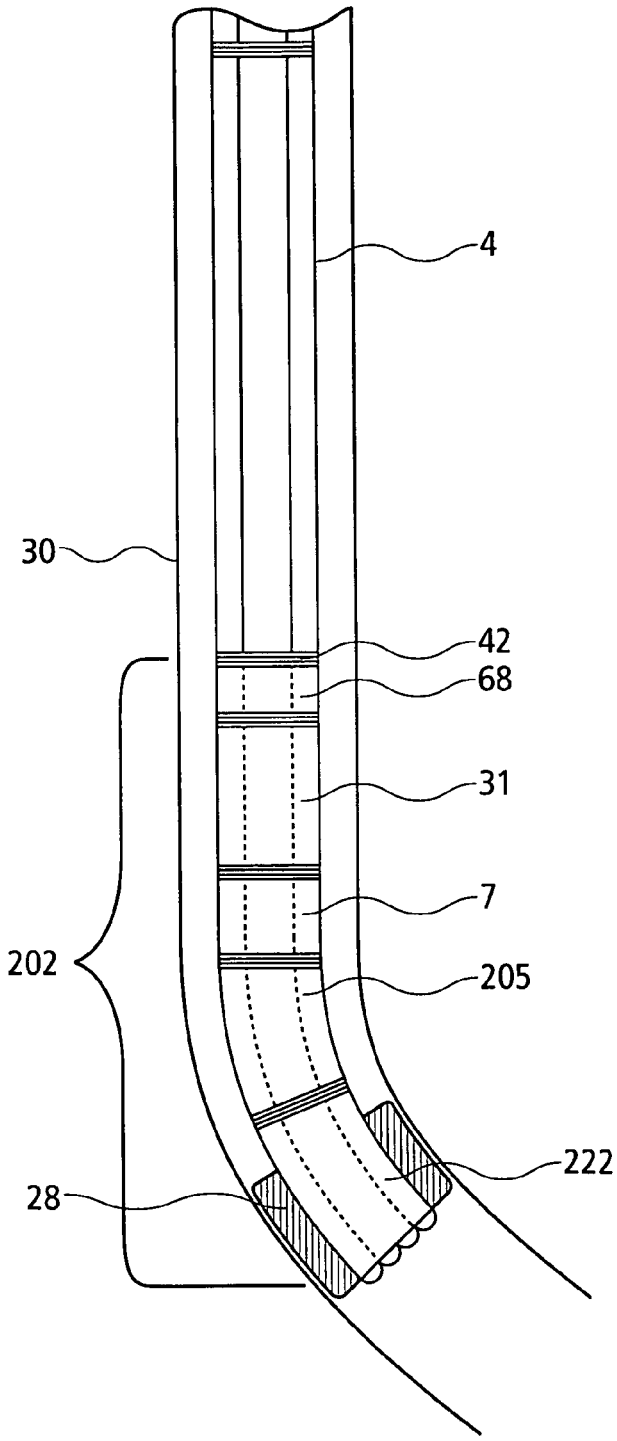
FIG. 3*a* is a schematic of a bottomhole assembly for drilling directional and horizontal wells with an air hammer.

FIG. 3*a* is a schematic of a bottomhole assembly for drilling directional and horizontal wells with an air hammer. Bottomhole assembly 202 comprises reciprocating air hammer 222, said reciprocating air hammer shown in more detail in FIG. 3*b*. The bottomhole assembly 202 is attached to concentric drill string 4 by threading means 42. Bottomhole assembly 2 further comprises bent sub 205 which positions air hammer 222 in the desired direction at a small angle offset from the axis of the concentric drill pipe. Shock sub 7 helps reduce the impact from the reciprocating air hammer 222 on MWD tool 31.

MWD tool 31 provides a number of evaluations of physical properties such as, but not limited to, pressure, temperature and wellbore trajectory in three-dimensional space. A LWD tool (not shown), which measures formation parameters such as resistivity, porosity, sonic, velocity and gamma, may also form part of the bottomhole assembly 2.

Figure 3B:
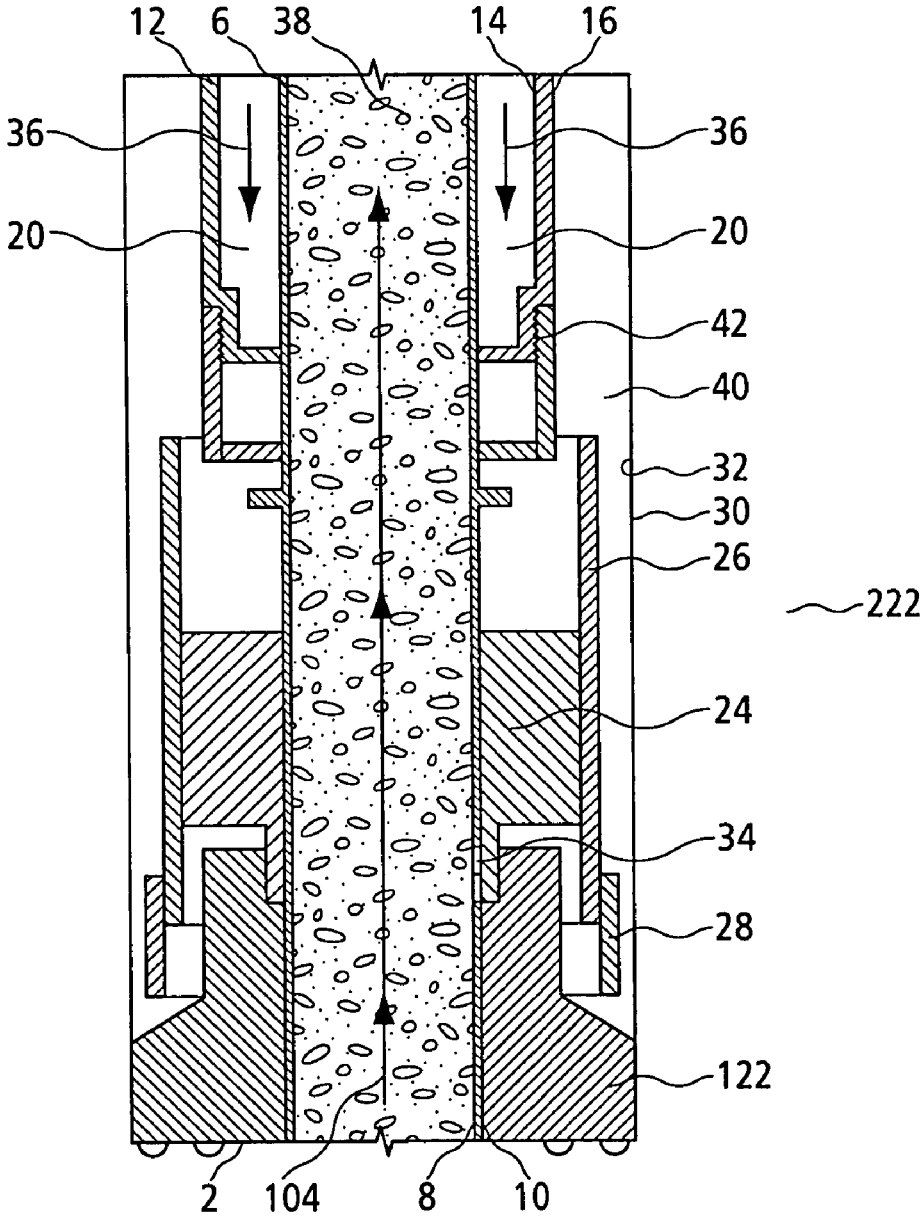
FIG. 3*b* is a vertical cross-section of an air hammer used with concentric drill string.

FIG. 3*b* is a vertical cross-section of reciprocating air hammer 222 which is operated by compressed air 36 traveling down concentric drill string annulus 20. The reciprocating air hammer 222 comprises a wearing drill bit 122. Wearing drill bit 122 is connected to a reciprocating piston 24 within piston casing 26. Venturi 34, positioned between the reciprocating piston 24 and the inner pipe 6, directs and accelerates exhaust air from the reciprocating piston 24 to the inner pipe 6. The compressed air 36 is of sufficient velocity to pick up and carry all drill cuttings 38 to the surface of the wellbore through the inner pipe 6. If required, a suction compressor at the surface can be attached to inner pipe 6 to assist in the discharge of the drill cuttings 38.

A shroud 28 may be located between the piston casing 26 and the formation 30 in relatively air tight and frictional engagement with the inner wellbore wall 32. Shroud 28 prevents compressed air 36 and drill cuttings from escaping up the formation annulus 40 between the outside wall 16 of the outer pipe 12 of the concentric drill string 4 and the inner wellbore wall 32.

In another embodiment of the present invention, compressed air can be pumped down the inner pipe 6 and the drill cuttings and exhaust compressed air carried to the surface of the wellbore through concentric drill string annulus 20.

Figure 4A:
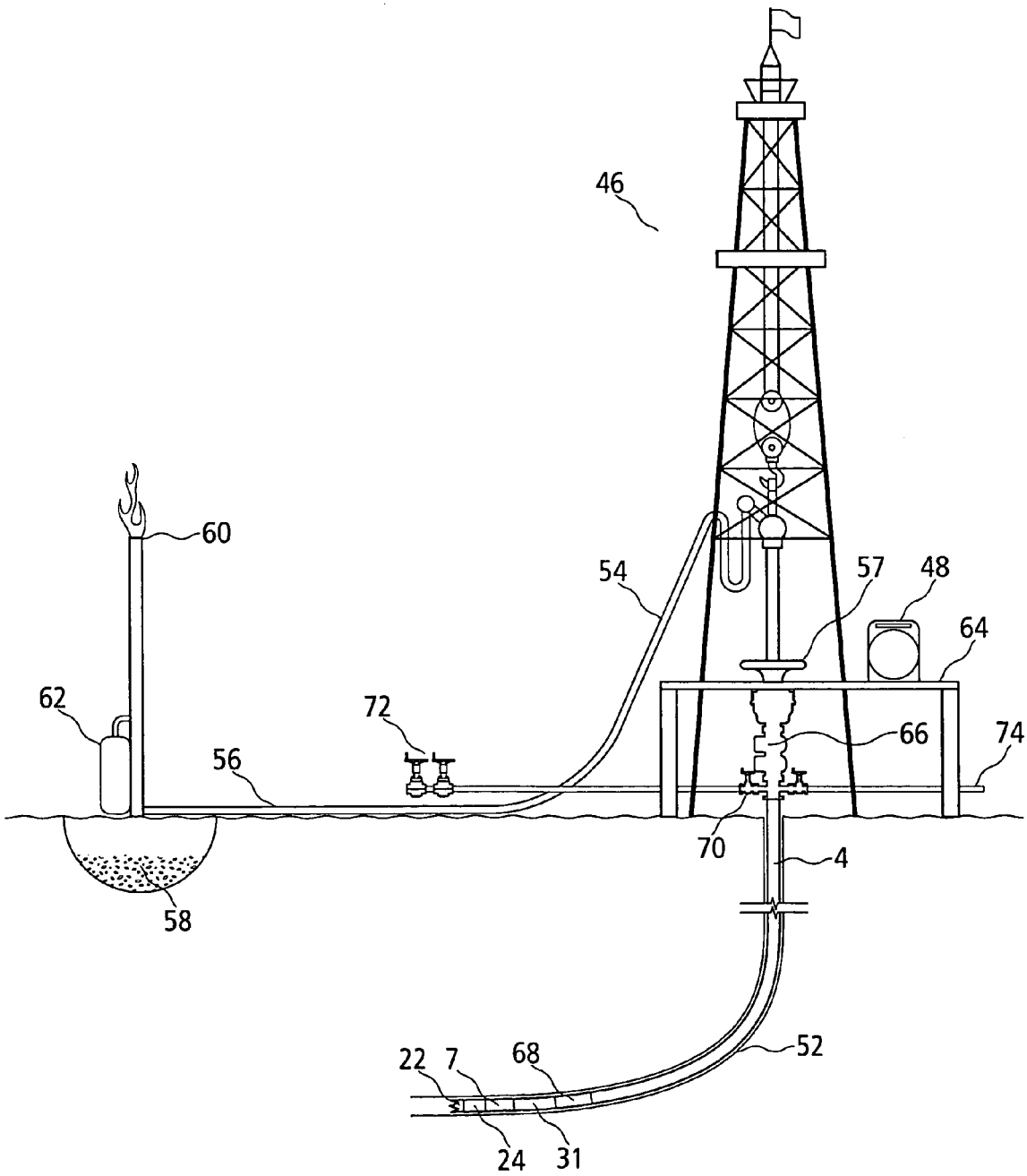
FIG. 4*a* is an illustration of a wellbore being drilled through subterranean formations in accordance with the present invention using compressed air as the drilling medium.

FIG. 4*a* shows a preferred embodiment of the present method and apparatus for safely drilling a directional or horizontal natural gas well or any well containing hydrocarbons using concentric drill string and compressed air as the drilling medium. Drilling rig 46 comprises air compressor 48 which pumps compressed air down the concentric drill string annulus of concentric drill string 4. Downhole assembly comprises a directional drilling means having a drill bit 22, bent sub 5 and air motor 24, and drill bit 22 operates to cut into the rock in wellbore 52. Downhole assembly further comprises shock sub 7, MWD tool 31, and downhole flow control means 68.

As drill bit 22 cuts through the rock, exhaust compressed air, drill cutting and hydrocarbons from formation bearing zones are carried up the inner pipe 6 of concentric drill string 4 as shown in more detail in FIG. 1. Discharge line 54 carries the exhaust compressed air, drill cuttings and hydrocarbons produced from the wellbore to blewie line 56. A suction type compressor (not shown) may be hooked up at the surface of the wellbore to assist in lifting the drilling medium, drill cutting and hydrocarbons up the inner pipe.

Drill cuttings are deposited in pit 58. Hydrocarbons produced through blewie line 56 are flared through flare stack 60 by means of propane torch 62 to atmosphere. Propane torch 62 is kept lit at all times during the drilling operations to ensure that all hydrocarbons are kept at least 100 feet away from the drilling rig floor 64.

In another preferred embodiment using compressed air as the drilling medium, the downhole assembly comprises a bent sub, a reciprocating air hammer and a MWD tool, as shown in FIG. 3*a*. The air hammer cuts through rock in the wellbore, exhaust compressed air, drill cuttings, and hydrocarbons from formation bearing zones are carried up the inner pipe 6 as shown in FIG. 1. Discharge line 54 carries the exhaust compressed air, drill cuttings and hydrocarbons produced from the wellbore to blewie line 56. A suction type compressor (not shown) may be hooked up at the surface of the wellbore to assist in lifting the drilling medium, drill cutting and hydrocarbons up the inner pipe.

Drill cuttings are deposited in pit 58. Hydrocarbons produced through blewie line 56 are flared through flare stack 60 by means of propane torch 62 to atmosphere. Propane torch 62 is kept lit at all times during the drilling operations to ensure that all hydrocarbons are kept at least 100 feet away from the drilling rig floor 64.

Figure 4B:
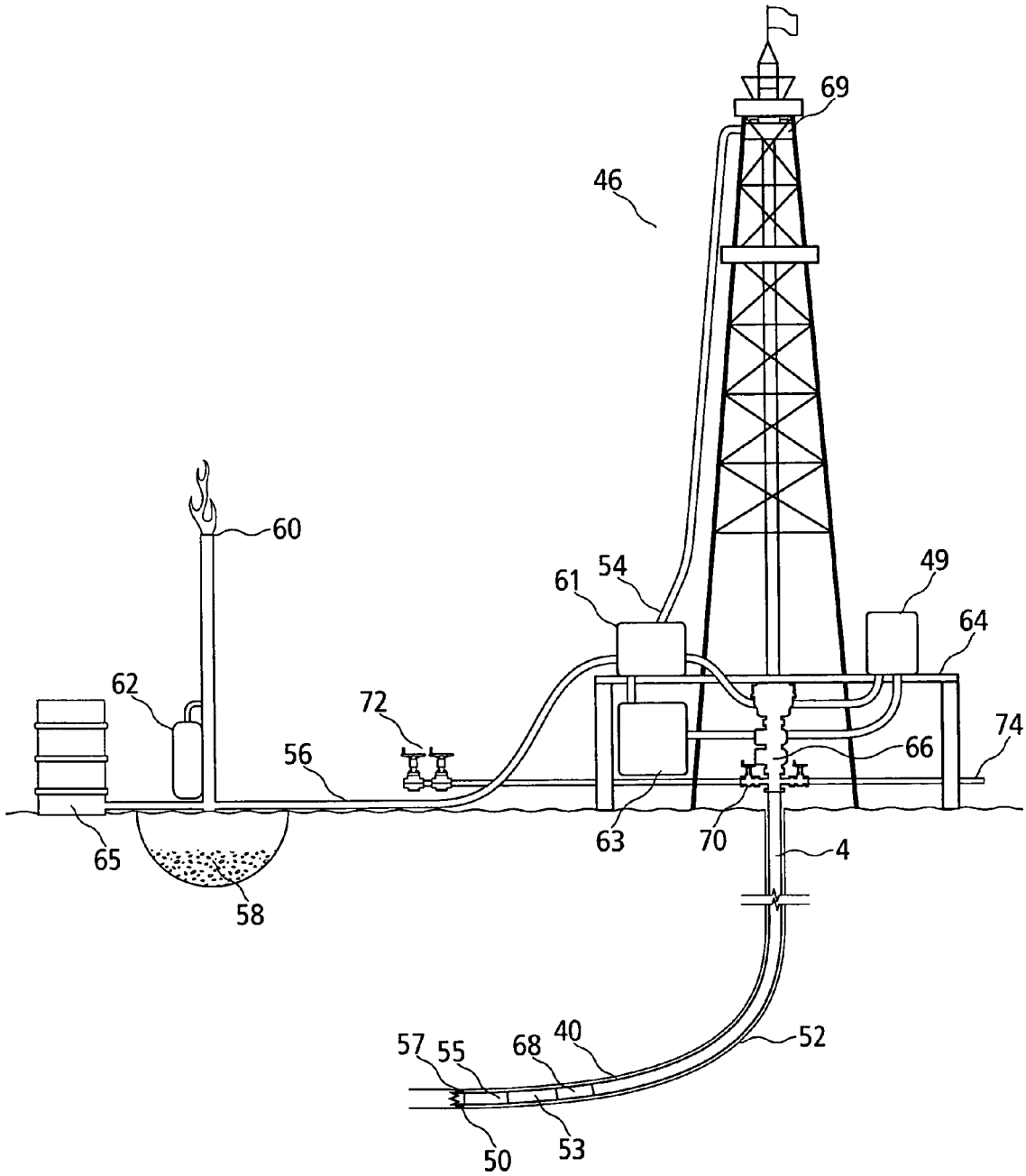
FIG. 4*b* is an illustration of a wellbore being drill through subterranean formations in accordance with the present invention using drilling fluids as the drilling medium.

FIG. 4*b* shows a preferred embodiment of the present invention for safely drilling a directional or horizontal natural gas well or any well containing hydrocarbons where the drilling medium is drilling fluids. Drilling rig 46 comprises drilling fluid pump system 49 which pumps drilling fluid down the concentric drill string annulus of concentric drill string 4. Downhole assembly comprises drill bit 50, a bent housing mud motor 55, and MWD tool 53, the latter two of which are used to power and direct drill bit 50. As drill bit 50 cuts through the formation rock in wellbore 52, returned drilling fluids, drilling cuttings and hydrocarbons from the formation bearing zones are carried up the inner pipe of concentric drill string 4.

Drill cuttings are deposited in pit 58. Hydrocarbons produced through blewie line 56 are pumped into tank 65 or flared through flare stack 60 by means of propane torch 62 to atmosphere. Propane torch 62 is kept lit at all times during the drilling operations to ensure that all hydrocarbons are kept at least 100 feet away from the drilling rig floor 64.

Shroud 57 may be placed around drill bit 50 to prevent drilling fluids and drill cuttings from escaping up the formation annulus 40 between the outside wall 16 of the outer pipe 12 of the concentric drill string 4 and the inner wellbore wall 32 as shown in FIG. 3*a*.

In FIG. 4*a*, the directional drilling means is rotated by rotary table 57 as is understood in the art. In FIG. 4*b*, the directional drilling means is rotated by top drive 59 as is understood in the art.

Figure 5:
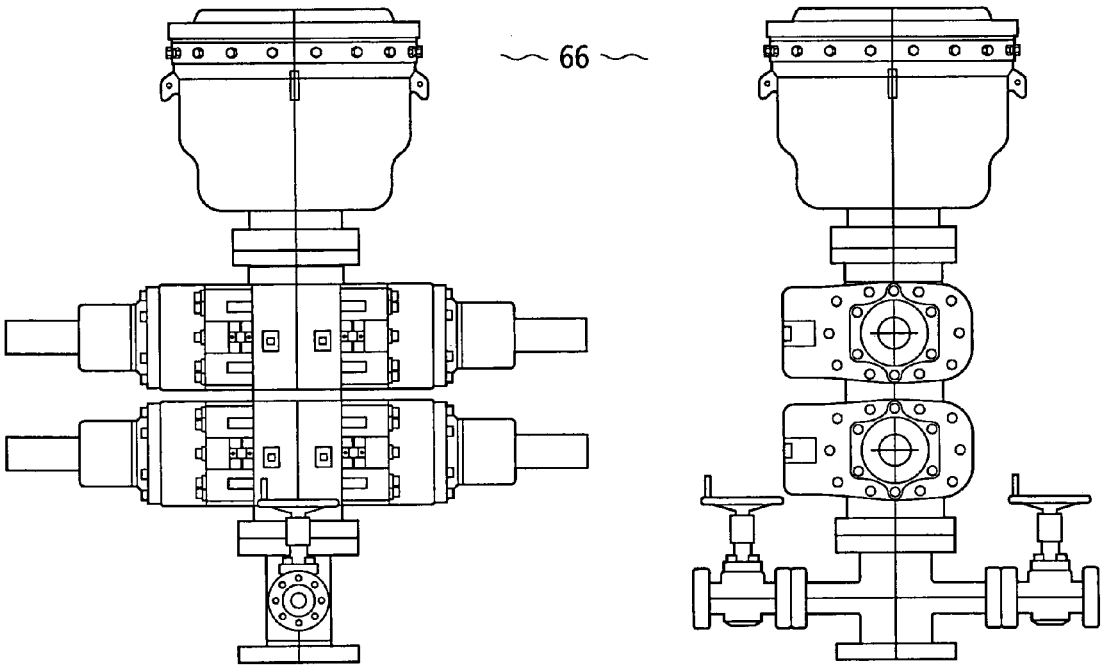
FIG. 5 is a perspective of a surface flow control means.

It is a preferred feature of the present invention that a surface flow control means or surface annular blowout preventor 66 be provided to prevent hydrocarbons from escaping from the formation annulus between the inner wellbore wall and the outside wall of the outer pipe of the concentric drill string during certain operations such as tripping concentric drill string in or out of the wellbore. An example of a suitable surface annular blowout preventor 66 is shown in FIG. 5. Other surface blowout preventors that can be used are taught in U.S. Pat. Nos. 5,044,602, 5,333,832 and 5,617,917, incorporated herein by reference.

It is preferable that the surface annular blowout preventor contain a circular rubber packing element (not shown) made of neoprene synthetic rubber or other suitable material that will allow the surface annular blowout preventor to seal around the shape of an object used downhole, for example, drill pipe, air hammer, drill bits, and other such drilling and logging tools.

Surface annular blowout preventor 66 is not equipped to control hydrocarbons flowing up the inside of concentric drill string 4, however. Therefore, preferably a second downhole flow control means or blowout preventor 68 is used to prevent hydrocarbons from coming up inner pipe 6 and concentric drill string annulus 20. For example, when concentric drill string 4 is tripped out of the wellbore, downhole flow control means 68 should be in the closed position to ensure maximum safety. This allows for the safe removal of all joints of concentric drill string from the wellbore without hydrocarbons being present on the drill rig floor 64. The downhole flow control means 68 is preferably attached at or near the drilling apparatus for maximum effectiveness.

Figure 6:
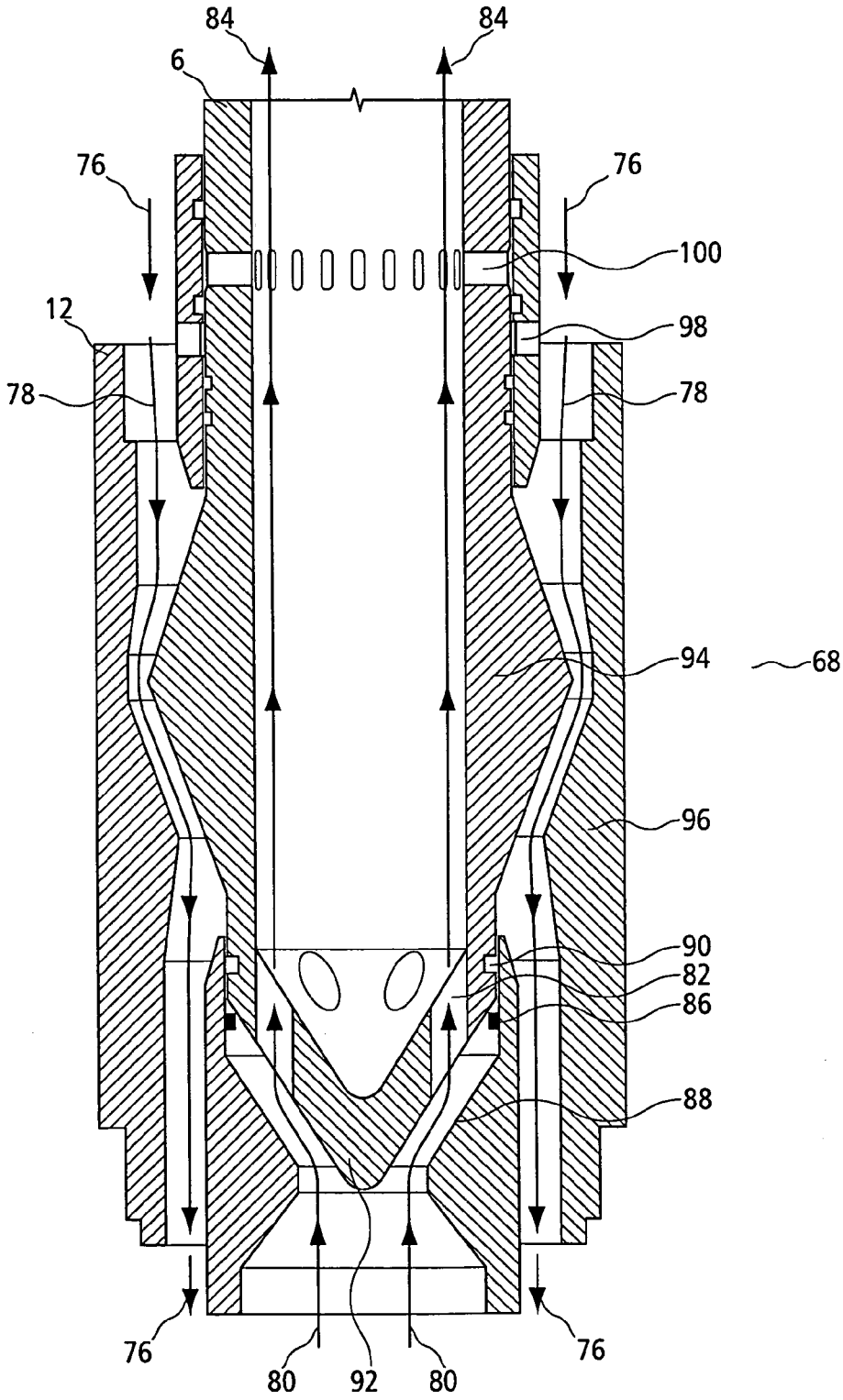
FIG. 6 is a vertical cross-section of one embodiment of a downhole flow control means.

One embodiment of downhole flow control means 68 is shown in greater detail in FIG. 6. This figure shows downhole flow control means 68 in the open position, where drilling medium 76 can flow down concentric drill string annulus 20 and in communication with flow path 78. Drilling medium 76 is allowed to continue through flow control means 68 and ultimately communicate with and power the directional drilling means of the bottomhole assembly. Exhausted drilling medium, drill cuttings and hydrocarbons can flow freely from bottomhole assembly up flow path 80.

Exhausted drilling medium, drill cuttings and hydrocarbons then flow through ports 82 which allow for communication with the inner pipe 6 through flow path 84.

When desired, flow paths 78 and 80 can be closed by axially moving inner pipe 6 downward relative to outer pipe 12, or conversely moving outer pipe 12 upward relative to inner pipe 6. Inner pipe 6 can be locked into place relative to outer string 12. A friction ring 86 on surface 88 aligns with recess 90 on surface 92 to lock the inner pipe 6 and outer pipe 12 together until opened again by reversing the movement. When in the closed position, surface 92 is forced against surface 88 to close off flow path 80. Similarly, surface 94 is forced against surface 96 to seal off flow path 78. Applying axial tension between the two pipes reverses the procedure, and restores flow through flow path 78 and 80.

An optional feature of flow control means 68 is to provide a plurality of offsetting ports 98 and 100 which are offset while the downhole flow control means is open, but are aligned when the downhole flow control means is in the closed position. The alignment of the plurality of ports 98 and 100 provide a direct flow path between now paths 78 and 80. This feature would allow for continued circulation through the inner pipe 6 and the concentric drill string annulus 20 for the purpose of continuous removal of drill cutting from the concentric drill string while the downhole flow control means 68 is in the closed position.

The downhole flow control means can also be used when drilling with air, drilling mud, drilling fluids, gases or various combinations of each. However, when the drilling medium used is drilling mud or drilling fluid, an alternate downhole flow control means can be used which only shuts down flow through the inner pipe 6. This is because the hydrocarbons would likely not be able to escape through the drilling mud or drilling fluid remaining in concentric drill string annulus 20. One embodiment of such a downhole flow control means is shown in FIGS. 7*a* and 7*b*, FIGS. 8*a* and 8*b*, FIG. 9 and FIG. 10. This flow control means is further described in more detail in U.S. patent application, Ser. No. 10/321,087, incorporated herein by reference.

Figure 7A:
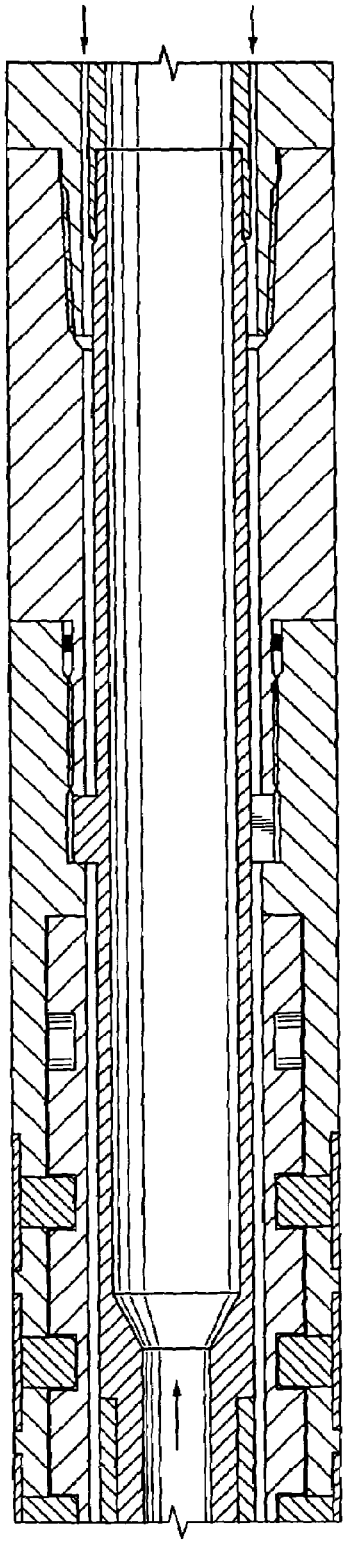
FIGS. 7*a* and 7*b* show a vertical cross-section of the top portion and bottom portion, respectively, of another embodiment of a downhole flow control means in the open position.
Figure 7B:
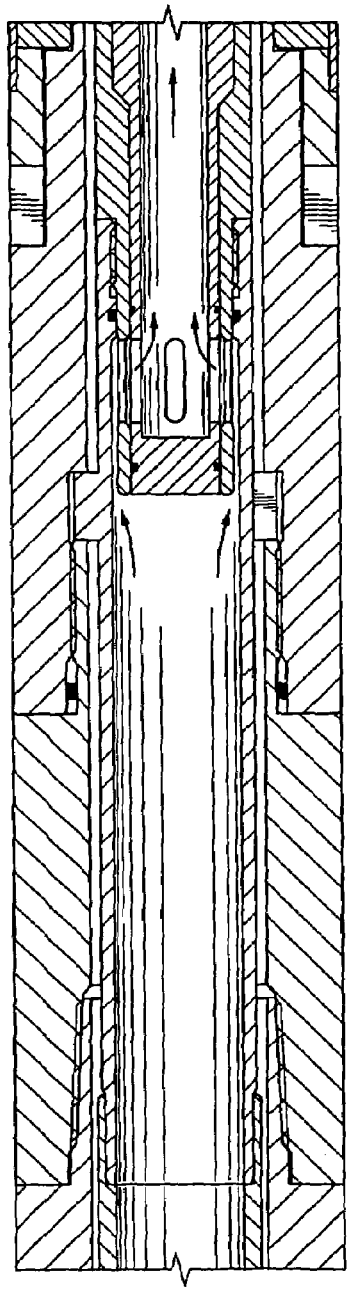
Figure 8A:
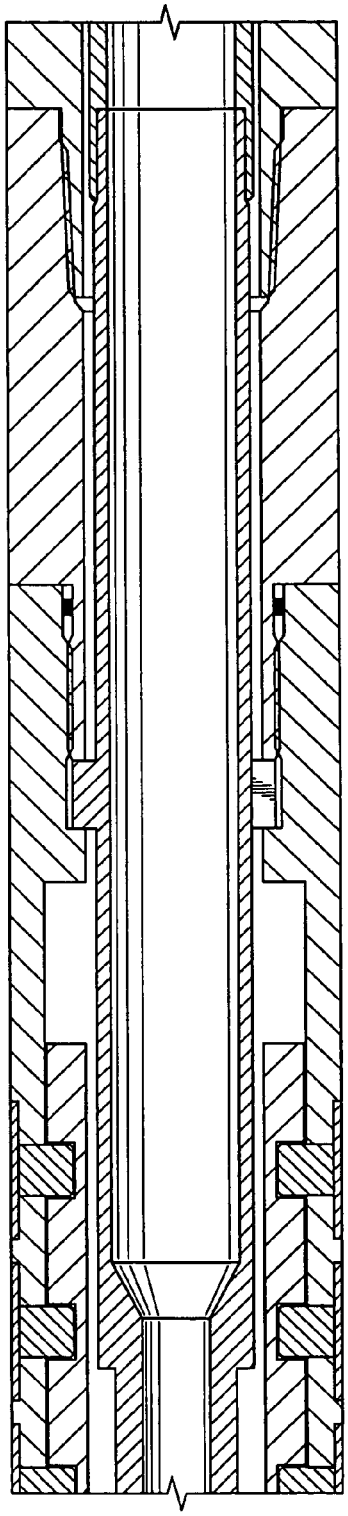
FIGS. 8*a* and 8*b* show a vertical cross-section of the top portion and bottom portion, respectively, of the downhole flow control means shown in 6*a* and 6*b* in the dosed position.
Figure 8B:
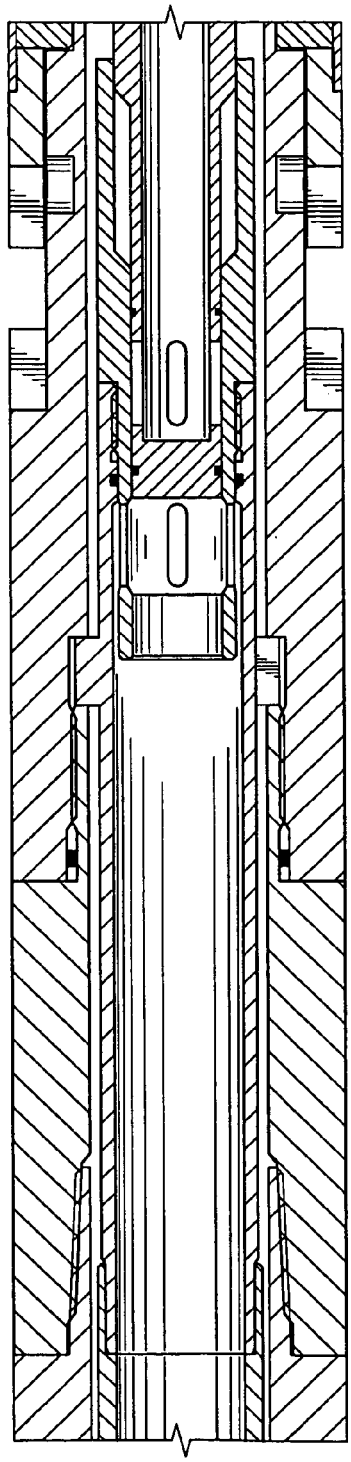
Figure 9:
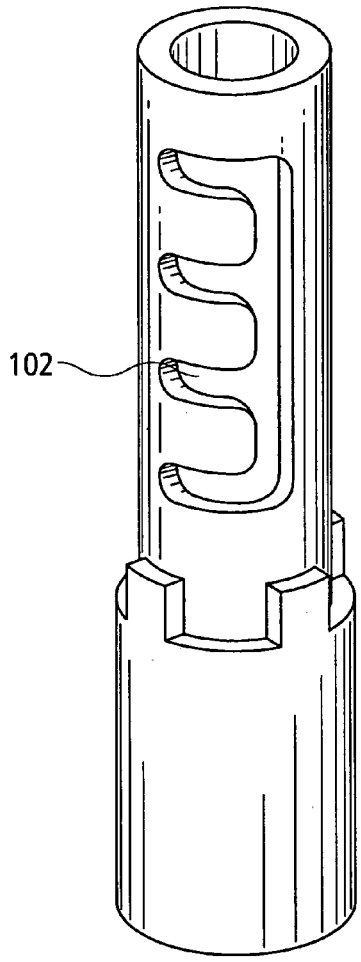
FIG. 9 is a perspective of the plurality of flow through slots of the downhole flow control means shown in 7*a* and 7*b* in the open position.
Figure 10:
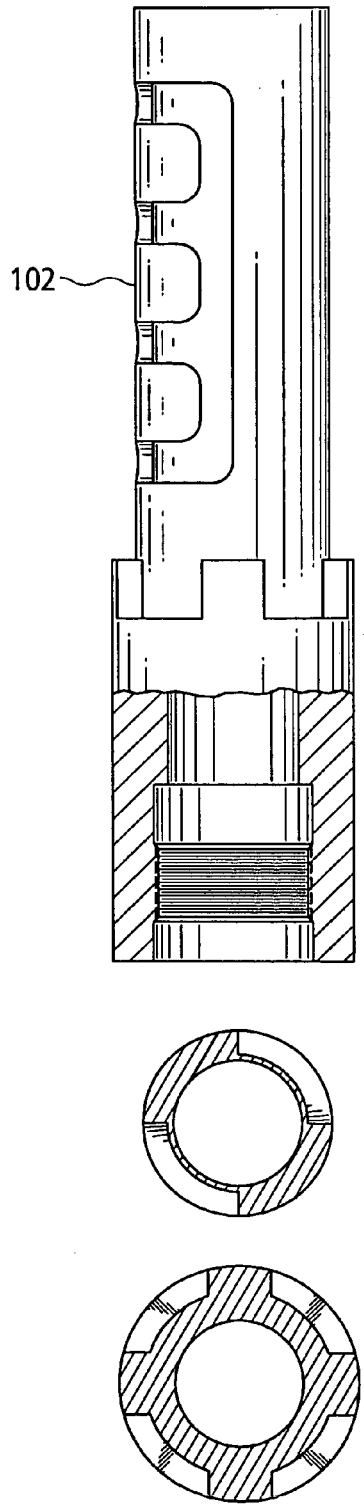
FIG. 10 is a perspective of the plurality of flow through slots of the downhole flow control means shown in 8*a* and 8*b* in the closed position.

FIGS. 7*a* and 7*b* show the downhole flow control means 680 in the open position, where exhausted compressed air, drilling mud or fluids, drill cuttings and hydrocarbons can flow freely up the concentric drill string attached thereto to the surface of the wellbore. FIGS. 8*a* and 8*b* show the downhole flow control means 680 in the dosed position. To place the downhole flow control means 680 in the closed position, the concentric drill string must be resting solidly on the bottom of the wellbore. The entire concentric drill string is rotated three quarters of one turn to the left. The mechanical turning to left direction closes a plurality of flow through slots 102, shown in FIG. 9 in the open position. The closed position of the downhole flow control means 680 is shown in FIG. 10 where the plurality of flow through slots 102 is in the closed position.

To open the downhole flow control means 680, the downhole flow control means 680 is place solidly on the bottom of the wellbore and the entire concentric drill string 680 is rotated back to the right, three quarters of one turn. This will restore the plurality of flow through slots 102 to the open position.

It often occurs during drilling operations that a "kick" or overpressure situation occurs down in the wellbore. If this occurs, both the surface annular blowout preventor 66 and the downhole flow control means 68 would be put into the closed position. Diverter line 70 and manifold choke system 72 would be used to reduce the pressure in the wellbore. If this fails to reduce the pressure in the wellbore then drilling mud or fluid could be pumped down the kill line 74 to regain control of the well.

While various embodiments in accordance with the present invention have been shown and described, it is understood that the same is not limited thereto, but is susceptible of numerous changes and modifications as known to those skilled in the art, and therefore the present invention is not to be limited to the details shown and described herein, but intend to cover all such changes and modifications as are encompassed by the scope of the appended claims.

I claim:

1. A method of drilling a directional or horizontal wellbore in a hydrocarbon formation, comprising:

providing a concentric drill string comprising an inner pipe having an inside wall and an outside wall and an outer pipe having an inside wall and an outside wall, said outside wall of said inner pipe and said inside wall of said outer pipe defining an annulus between the pipes;

connecting a bottomhole assembly, said bottomhole assembly comprising a directional drilling means for forming a borehole, to the concentric drill string;

delivering drilling medium through one of said annulus or inner pipe to the directional drilling means and removing exhaust drilling medium by extracting said exhaust drilling medium through the other of said annulus or inner pipe to the surface of the wellbore; and providing a downhole flow control means positioned at or near the directional drilling means, said downhole flow control means having an open position and a closed position, whereby said downhole flow control means is in the open position during active drilling to allow the flow of drilling medium or exhaust drilling medium through the inner pipe and the annulus and in the closed position when well control is necessary to prevent the flow of hydrocarbons through the inner pipe and the annulus to the surface of the wellbore.

2. A method of drilling a directional or horizontal wellbore in a hydrocarbon formation, comprising:

providing a concentric drill string comprising an inner pipe having an inside wall and an outside wall and an outer pipe having an inside wall and an outside wall, said outside wall of said inner pipe and said inside wall of said outer pipe defining an annulus between the pipes;

connecting a bottomhole assembly, said bottomhole assembly comprising a directional drilling means for forming a borehole and one or more tools selected from the group consisting of a downhole data collection and transmission means, a shock sub, a drill collar and an interchange means, to the concentric drill string;

delivering drilling medium through one of said annulus or inner pipe to the directional drilling means and removing exhaust drilling medium by extracting said exhaust drilling medium through the other of said annulus or inner pipe to the surface of the wellbore; and providing a downhole flow control means positioned at or near the directional drilling means, said downhole flow control means having an open position and a closed position, whereby said downhole flow control means is in the open position during active drilling to allow the flow of drilling medium or exhaust drilling medium through the inner pipe and the annulus and in the closed position when well control is necessary to prevent the flow of hydrocarbons through the inner pipe and the annulus to the surface of the wellbore.

3. The method of claim 1 or 2 wherein the drilling medium is delivered through the annulus and the exhaust drilling medium is extracted through the inner pipe.

4. The method of claim 1 or 2 wherein the drilling medium is delivered through the inner pipe and exhaust drilling medium is extracted through the annulus.

5. The method of claim 1 or 2 wherein drilling cuttings are extracted together with the exhaust drilling medium.

6. The method of claim 1 or 2 wherein drilling cuttings and hydrocarbons are extracted together with the exhaust drilling medium.

7. The method of claim 1 or 2 wherein said directional drilling means is a reverse circulating directional drilling means.

8. The method of claim 1 or 2 further comprising providing a surface flow control means positioned at or near the surface of the wellbore for preventing flow of hydrocarbons from a space between the outside wall of the outer pipe and a wall of the wellbore.

9. The method of claim 8, said surface flow control means further comprising a discharging means, said method further comprising removing said exhaust drilling medium through said discharging means from said wellbore.

10. The method of claim 9 wherein said discharging means further comprises a flare means for flaring hydrocarbons produced from the wellbore.

11. The method of claim 1 or 2 wherein said drilling medium comprises air and said directional drilling means comprises a reciprocating air hammer, a drill bit and a bent sub or housing.

12. The method of claim 11 wherein said reciprocating air hammer is a reverse circulating reciprocating air hammer.

13. The method of claim 1 or 2 wherein said drilling medium comprises air and said directional drilling means comprises a rotary drill bit and a bent sub or housing, said directional drilling means being operated by a rotary table or top drive drilling system.

14. The method of claim 1 or 2 wherein said drilling medium comprises air and said directional drilling means comprises a drill bit, a steerable downhole air motor and a bent sub or housing.

15. The method of claim 14 wherein said steerable downhole air motor is a reverse circulating steerable downhole air motor.

16. The method of claim 1 or 2 wherein said drilling medium comprises drilling mud and said directional drilling means comprises a drill bit, a mud motor and a bent sub or housing.

17. The method of claim 16 wherein said mud motor is a reverse circulating mud motor.

18. The method of claim 1 or 2 wherein said drilling medium is selected from the group consisting of drilling mud, drilling fluid, gases and a combination thereof, and said directional drilling means comprises a drill bit and a bent sub or housing.

19. The method of claim 1 or 2, said directional drilling means further comprising a venturi, said method further comprising accelerating said exhaust drilling medium through said venturi so as to facilitate removal of said exhaust drilling medium from the concentric drill string.

20. The method of claim 1 or 2 further comprising providing a shroud means positioned between the outside wall of the outer pipe and a wall of the wellbore for preventing release of exhaust drilling medium outside the concentric drill string and into the formation.

21. The method of claim 1 or 2 further comprising providing a suction type compressor means for extracting said exhaust drilling medium through said annulus or inner pipe.

22. The method of claim 1 further comprising providing an interchange means for directing said exhaust drilling medium through said annulus or inner pipe.

23. The method of claim 2 wherein said downhole data collection and transmission means comprises a measurement-while-drilling tool or a logging-while drilling tool or both.

24. An apparatus for drilling a directional or horizontal wellbore in a hydrocarbon formation, comprising:

a concentric drill string comprising an inner pipe having an inside wall and an outside wall and an outer pipe having an inside wall and an outside wall, said outside wall of said inner pipe and said inside wall of said outer pipe defining an annulus between the pipes;

a bottomhole assembly, said bottomhole assembly comprising a directional drilling means for forming a borehole and a downhole flow control means having an open position and a closed position, operably connected to the concentric drill string;

a drilling medium delivery means for delivering drilling medium through one of said annulus or inner pipe to the directional drilling means for entraining and removing drill cuttings through the other of said annulus or inner pipe;

whereby when the downhole flow control means is in the open position drilling medium can flow through both the inner pipe and the annulus and when the downhole flow control means is in the closed position hydrocarbons are prevented from flowing through both the inner pipe and the annulus to the surface of the wellbore.

25. The apparatus of claim 24 further comprising a surface flow control means positioned at or near the surface of the wellbore for preventing flow of hydrocarbons from a space between the outside wall of the outer pipe and a wall of the wellbore.

26. The apparatus of claim 25 further comprising a discharging means attached to said surface flow control means for discharging said drilling medium and said entrained drill cuttings from the wellbore.

27. The apparatus of claim 26 further comprising a flare means attached to said discharging means for flaring hydrocarbons produced from the wellbore.

28. The apparatus of claim 24 wherein said directional drilling means is a reverse circulating directional drilling means.

29. The apparatus of claim 24 wherein drilling medium comprises air and directional drilling means comprises a reciprocating air hammer, a drill bit and a bent sub or housing.

30. The apparatus of claim 29 wherein said reciprocating air hammer is a reverse circulating reciprocating air hammer.

31. The apparatus of claim 24 wherein drilling medium comprises air and directional drilling means comprises a rotary drill bit and a bent sub or housing, said directional drilling means being operated by a rotary table or top drive drilling system.

32. The apparatus of claim 24 wherein said drilling medium comprises air and said directional drilling means comprises a drill bit, a steerable downhole air motor and a bent sub or housing.

33. The apparatus of claim 32 wherein said steerable downhole air motor is a reverse circulating steerable downhole air motor.

34. The apparatus of claim 24 wherein said drilling medium comprises drilling mud and said directional drilling means comprises a drill bit, a downhole mud motor and a bent sub or housing.

35. The apparatus of claim 34 wherein said downhole mud motor is a reverse circulating downhole mud motor.

36. The apparatus of claim 24 wherein drilling medium is selected from the group consisting of drilling mud, drilling fluid and gases and a combination thereof, and said directional drilling means comprises a drill bit and a bent sub or housing.

37. The apparatus of claim 24, wherein the directional drilling means further comprising a venturi for accelerating said drilling medium so as to facilitate removal of said drill cuttings from the concentric drill string.

38. The apparatus of claim 24 further comprising a shroud means positioned between the outside wall of the outer pipe and a wall of the wellbore for preventing release of drilling medium or entrained drill cuttings or both outside the concentric drill string and into the formation.

39. The apparatus of claim 24 further comprising a suction type compressor means positioned at or near the top of the wellbore for extracting said entrained drill cuttings through said annulus or inner pipe.

40. The apparatus of claim 24 wherein said bottomhole assembly further comprises one or more tools selected from the group consisting of a downhole data collection and transmission means, a shock sub, a drill collar, and an interchange means for directing said drilling medium and entrained drill cuttings through said annulus or inner pipe.

41. The apparatus of claim 40 wherein said downhole data collection and transmission means comprises a measurement-while-drilling tool or a logging-while drilling tool or both.

42. A method of drilling a directional or horizontal wellbore in a hydrocarbon formation, comprising:

providing a concentric drill string comprising an inner pipe, said inner pipe having an inside wall and an outside wall, and an outer pipe having an inside wall and an outside wall, said outside wall of said inner pipe and said inside wall of said outer pipe defining an annulus between the pipes;

connecting a bottomhole assembly, said bottomhole assembly comprising a directional drilling means for forming a borehole, to the concentric drill string; and delivering drilling medium through said inner pipe to said directional drilling means and removing exhaust drilling medium by extracting said exhaust drilling medium primary through said annulus to the surface of the wellbore;

providing a downhole flow control means positioned at or near the directional drilling means, said downhole flow control means having an open position and a closed position, whereby said downhole flow control means is in the open position during active drilling to allow the flow of drilling medium down through the inner pipe and exhaust drilling medium up through the annulus and in the closed position when well control is necessary to prevent the flow of hydrocarbons up through the annulus to the surface of the well bore.

43. A method of drilling a directional or horizontal wellbore in a hydrocarbon formation, comprising the steps of:

providing a concentric drill string comprising an inner pipe, said inner pipe having an inside wall and an outside wall, and an outer pipe having an inside wall and an outside wall, said outside wall of said inner pipe and said inside wall of said outer pipe defining an annulus between the pipes;

connecting a bottomhole assembly, said bottomhole assembly comprising a directional drilling means for forming a borehole, to the concentric drill string;

delivering drilling medium through said annulus to said directional drilling means and removing exhaust drilling medium by extracting said exhaust drilling medium through said inner pipe to the surface of the wellbore; and providing a downhole flow control means positioned at or near the directional drilling means, said downhole flow control means having an open position and a closed position, whereby said downhole flow control means is in the open position during active drilling to allow the flow of drilling medium down through the annulus and exhaust drilling medium up through the inner pipe and in the closed position when well control is necessary to prevent the flow of hydrocarbons up through the inner pipe to the surface of the wellbore.

44. The method of claim 42 or 43 whereby said drilling medium is selected from the group consisting of drilling fluid, drilling mud, a drilling fluid and gas mixture, and a drilling mud and gas mixture.

45. A method of drilling a directional or horizontal wellbore in a hydrocarbon formation, comprising the steps of:

providing a concentric drill string comprising an inner pipe, said inner pipe having an inside wall and an outside wall, and an outer pipe having an inside wall and an outside wall, said outside wall of said inner pipe and said inside wall of said outer pipe defining an annulus between the pipes;

connecting a bottomhole assembly, said bottomhole assembly comprising a directional drilling means for forming a borehole, to the concentric drill string;

delivering drilling medium through one of said annulus or inner pipe to said directional drilling means and removing exhaust drilling medium by extracting said exhaust drilling medium through said other of said annulus or inner pipe;

providing a surface flow control means positioned at or near the surface of the wellbore for preventing flow of hydrocarbons from a space between the outside wall of the outer pipe and a wall of the wellbore, said surface flow control means having a discharging means and said discharging means having a flare means; and removing said exhaust drilling medium through said discharging means from said wellbore and flaring any hydrocarbons produced from the wellbore.

46. An apparatus for drilling a directional or horizontal wellbore in a hydrocarbon formation, comprising:

a concentric drill string comprising an inner pipe, said inner pipe having an inside wall and an outside wall, and an outer pipe having an inside wall and an outside wall, said outside wall of said inner pipe and said inside wall of said outer pipe defining an annulus between the pipes;

a bottomhole assembly, said bottomhole assembly comprising a directional drilling means for forming a borehole and a downhole flow control means having an open position and a closed position, operably connected to the concentric drill string; and a drilling medium delivery means for delivering drilling medium through the inner pipe to the directional drilling means for entraining and removing drill cuttings through the annulus;

whereby said downhole flow control means is in the open position during active drilling to allow the flow of drilling medium down through the inner pipe and up through the annulus and in the closed position during well control operations to prevent the flow of hydrocarbons up through the annulus to the surface of the well bore.

47. An apparatus for drilling a directional or horizontal wellbore in a hydrocarbon formation, comprising:

a concentric drill string comprising an inner pipe, said inner pipe having an inside wall and an outside wall, and an outer pipe having an inside wall and an outside wall, said outside wall of said inner pipe and said inside wall of said outer pipe defining an annulus between the pipes;

a bottomhole assembly, said bottomhole assembly comprising a directional drilling means for forming a borehole, operably connected to the concentric drill string;

a drilling medium delivery means for delivering drilling medium through one of said annulus or inner pipe to the directional drilling means for entraining and removing drill cuttings through said other of said annulus or inner pipe;

a surface flow control means positioned at or near the surface of the wellbore for preventing flow of hydrocarbons from a space between the outside wall of the outer pipe and a wall of the wellbore;

a discharging means attached to said surface flow control means for discharging said drilling medium and said entrained drill cuttings from the wellbore; and a flare means attached to said discharging means for flaring any hydrocarbons produced from the wellbore.

48. An apparatus for drilling a directional or horizontal wellbore in a hydrocarbon formation, comprising:

a concentric drill string comprising an inner pipe, said inner pipe having an inside wall and an outside wall, and an outer pipe having an inside wall and an outside wall, said outside wall of said inner pipe and said inside wall of said outer pipe defining an annulus between the pipes;

a bottomhole assembly, said bottomhole assembly comprising a directional drilling means for forming a borehole and a downhole flow control means having an open position and a closed position, operably connected to the concentric drill string; and a drilling medium delivery means for delivering drilling medium through the annulus to the directional drilling means for entraining and removing drill cuttings through the inner pipe;

whereby said downhole flow control means is in the open position during active drilling to allow the flow of drilling medium down through the annulus and up through the inner pipe and in the closed position during well control operations to prevent the flow of hydrocarbons up through the inner pipe to the surface of the well bore.

49. A method of drilling a directional or horizontal wellbore in a hydrocarbon formation, comprising:

providing a concentric drill string consisting essentially of an inner pipe having an inside wall and an outside wall and an outer pipe having an inside wall and an outside wall, said outside wall of said inner pipe and said inside wall of said outer pipe defining an annulus between the pipes;

connecting a bottomhole assembly, said bottomhole assembly comprising a directional drilling means for forming a borehole, to the concentric drill string;

delivering drilling medium through one of said annulus or inner pipe to the directional drilling means and removing exhaust drilling medium by extracting said exhaust drilling medium primarily through said other of said annulus or inner pipe and to the surface of the wellbore by means of said other of said annulus or inner pipe;

providing a surface flow control means positioned at or near the surface of the wellbore for preventing flow of hydrocarbons from a space between the outside wall of the outer pipe and a wall of the wellbore, said surface flow control means having a discharging means and said discharging means having a flare means; and removing said exhaust drilling medium through said discharging means from said wellbore and flaring any hydrocarbons produced from the wellbore.

50. An apparatus for drilling a directional or horizontal wellbore in a hydrocarbon formation, comprising:

a concentric drill string consisting essentially of an inner pipe having an inside wall and an outside wall and an outer pipe having an inside wall and an outside wall, said outside wall of said inner pipe and said inside wall of said outer pipe defining an annulus between the pipes;

a bottomhole assembly, said bottomhole assembly comprising a directional drilling means for forming a borehole and one or more tools selected from the group consisting of a downhole data collection and transmission means, a shock sub, a drill collar and an interchange means for directing said drilling medium and entrained drill cuttings through said annulus or inner pipe, operably connected to the concentric drill string;

a drilling medium delivery means for delivering drilling medium through one of said annulus or inner pipe to the directional drilling means for entraining and removing drill cuttings through said other of said annulus or inner pipe;

a surface flow control means positioned at or near the surface of the wellbore for preventing flow of hydrocarbons from a space between the outside wall of the outer pipe and a wall of the wellbore;

a discharging means attached to said surface flow control means for discharging said drilling medium and said entrained drill cuttings from the wellbore; and a flare means attached to said discharging means for flaring hydrocarbons produced from the wellbore.

* * * * *